US005545111A

United States Patent [19]

Wang et al.

[11] Patent Number: 5,545,111

[45] Date of Patent: Aug. 13, 1996

[54] STEPPING MACHINE

[76] Inventors: Mei-San Wang, No. 27-3, Lane 31, Sec. 1, San Ming Rd.; Lee-Hwei Hsu, No. 67, Lane 6, Tsui Hwa Street, both of Panchiao City, Taipei Hsien, Taiwan

[21] Appl. No.: 573,151

[22] Filed: Dec. 15, 1995

[51] Int. Cl.[6] ..... A63B 22/04

[52] U.S. Cl. ..... 482/53; 482/147

[58] Field of Search ..... 482/51, 52, 53, 482/79, 80, 146, 147, 148, 111, 112

[56] References Cited

U.S. PATENT DOCUMENTS

| | | | |
|---|---|---|---|
| 2,906,532 | 9/1959 | Echols | 482/146 |
| 4,390,180 | 6/1983 | Simjian | 482/146 |
| 4,563,001 | 1/1986 | Terauds | 482/53 |
| 5,230,675 | 7/1993 | Lin | 482/80 |
| 5,246,410 | 9/1993 | Fun | 482/53 |
| 5,290,204 | 3/1994 | Lee | 482/53 |
| 5,298,002 | 3/1994 | Lin | 482/53 |
| 5,453,065 | 9/1995 | Lien et al. | 482/146 |

*Primary Examiner*—Stephen R. Crow
*Attorney, Agent, or Firm*—Varndell Legal Group

[57] ABSTRACT

A stepping machine including a base frame having an upright stub tube and an upright shaft, the upright stub tube having two horizontal axles and two connecting plates respectively turned about the horizontal axles, an upright post revolvably mounted on the upright stub tube and having a transverse handlebar at the top, a pedal support revolvably mounted on the upright shaft and coupled to the upright support in a parallel relation, two pedals respectively turned about a respective horizontal axle on the pedal support, and two hydraulic cylinders bilaterally connected between the pedal support and the free ends of the pedals, each pedal having a downward rod at the fixed end and coupled to one connecting plate.

1 Claim, 5 Drawing Sheets

STEPPING MACHINE

BACKGROUND AND SUMMARY OF THE INVENTION

The present invention relates to stepping machines, and relates more particularly to such a stepping machine which is practical for exercising the legs as well as the waist.

FIG. 1 shows a conventional stepping machine which is comprised of a base frame, downward hydraulic cylinders bilaterally mounted on the upright post of the base frame, and two pedals pivotably connected to the base frame and respectively suspended from the piston rods of the hydraulic cylinders. This structure of stepping machine is functional, however it is practical for exercising the muscles of the legs only.

It is the major object of the present invention to provide a stepping machine which forces the user to twist the body when the user steps on the pedals alternatively. According to the preferred embodiment of the present invention, the stepping machine comprises a base frame having an upright stub tube and an upright shaft, the upright stub tube having two horizontal axles and two connecting plates respectively turned about the horizontal axles, an upright post revolvably mounted on the upright stub tube and having a transverse handlebar at the top, a pedal support revolvably mounted on the upright shaft and coupled to the upright support in a parallel relation, two pedals respectively turned about a respective horizontal axle on the pedal support, and two hydraulic cylinders bilaterally connected between the pedal support and the free ends of the pedals. Each of the pedals has a downward rod at the fixed end and coupled to one connecting plate by links. Therefore, when the user steps on the pedals alternatively, the pedal support and the upright post are respectively turned back and forth, and the user is forced to twist the waist.

DETAILED DESCRIPTION OF THE PREFERRED EMBODIMENT

Figure 1:
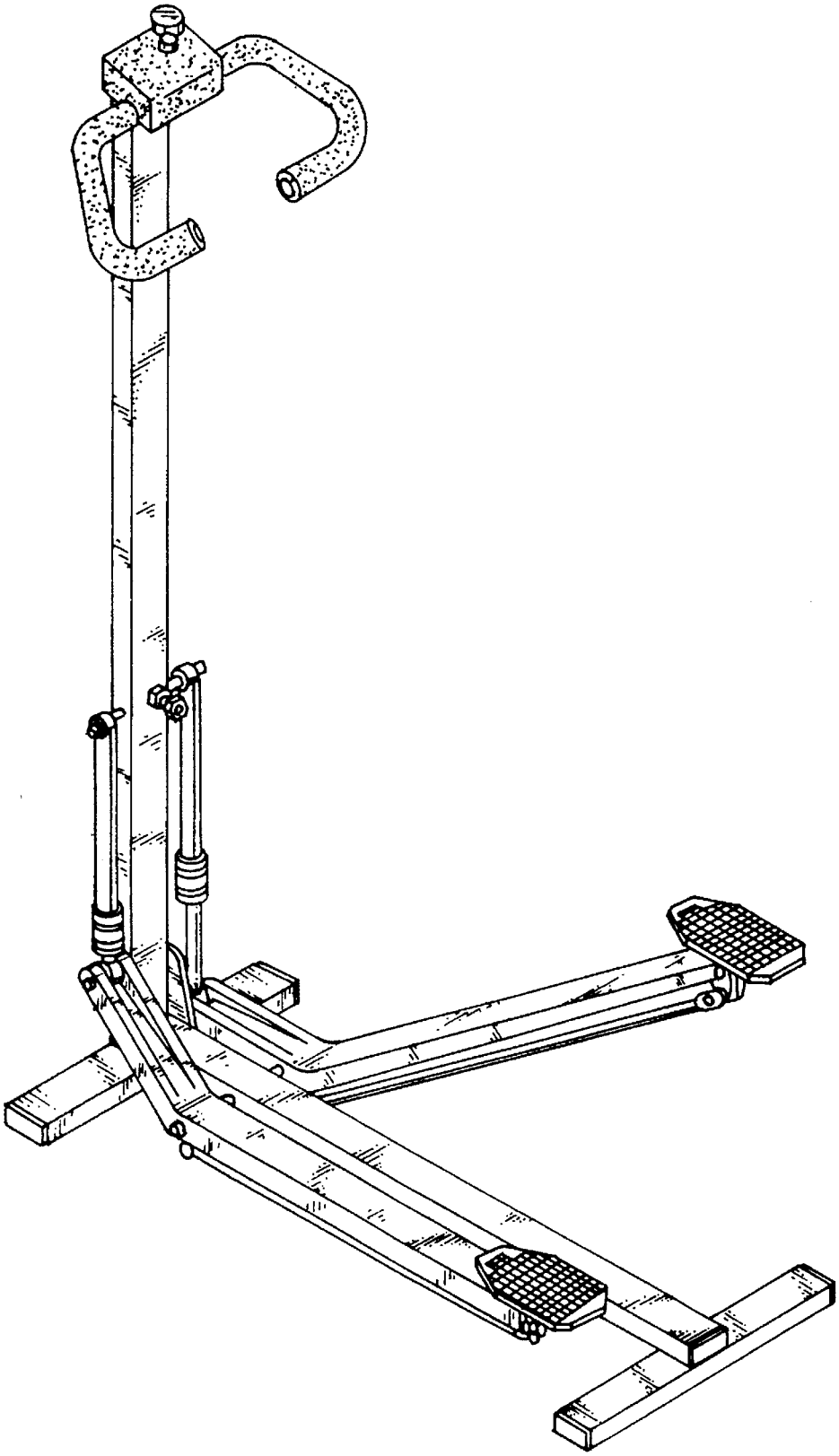
Fig·1 PRIOR ART
FIG. 1 is an elevational view of a stepping machine according to the prior art.
Figure 2:
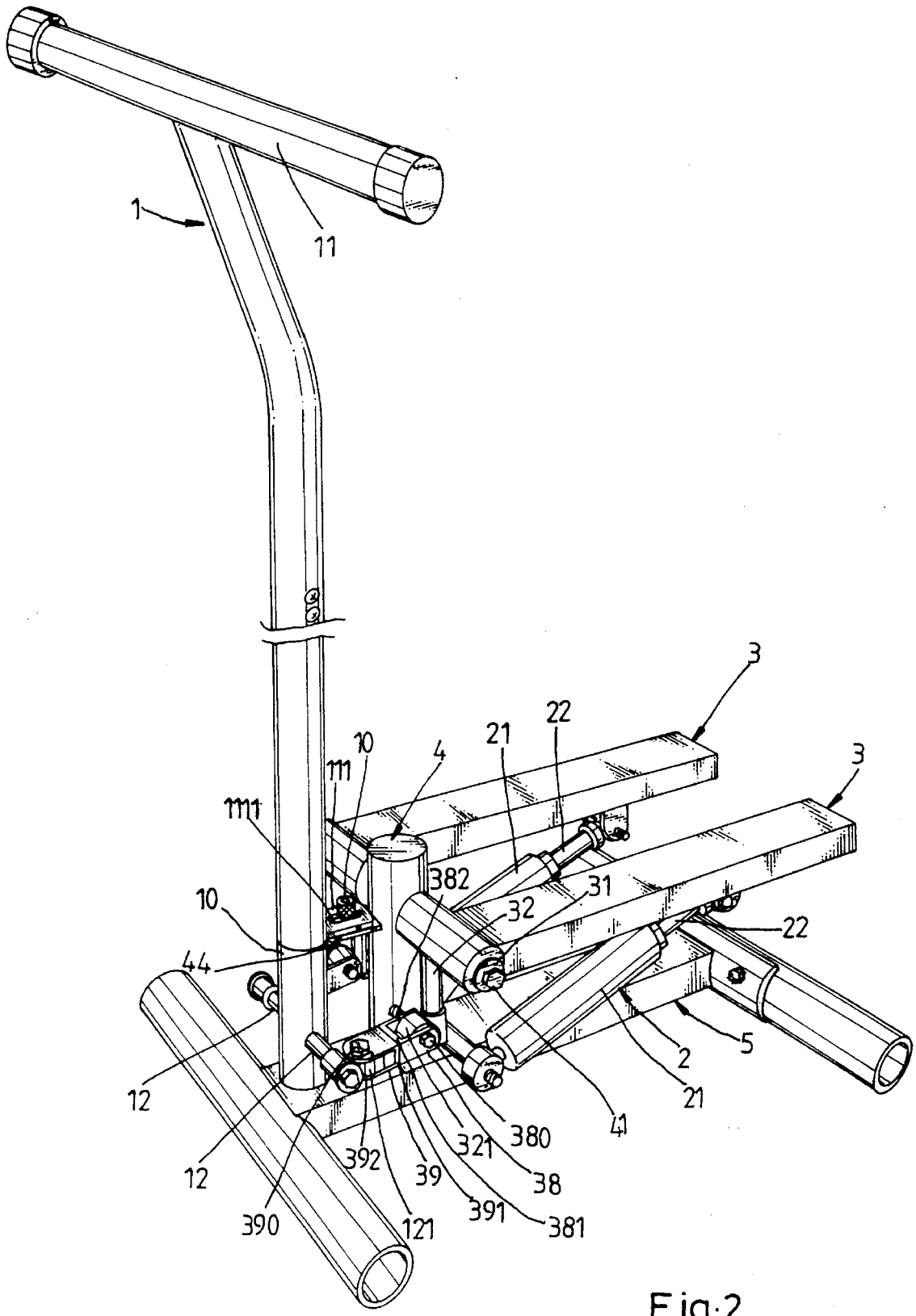
FIG. 2 is an elevational view of a stepping machine according to the present invention.
Figure 3:
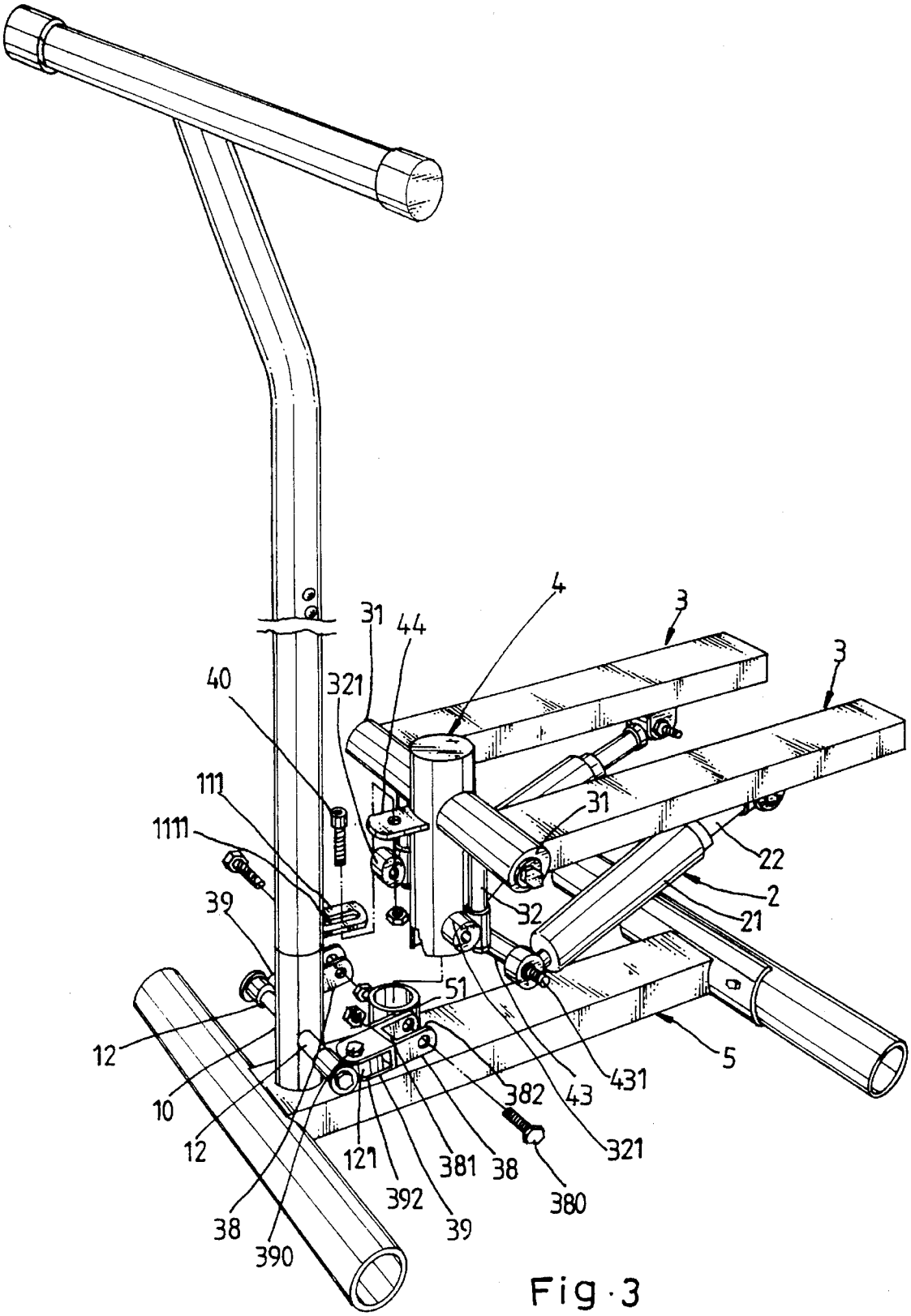
FIG. 3 is similar to FIG. 2 but showing the pedal support dismounted from the base frame.

Referring to FIGS. 2 and 3, a stepping machine in accordance with the present invention is generally comprised of a base frame 5, an upright frame 1 raised from one end of the base frame 5 and having a transverse handlebar 11 at the top, a pedal support 4 mounted on the base frame 5 adjacent to the upright frame 1 had having two horizontal axles 41 bilaterally disposed at the same elevation near the top, two pedals 3, each pedal 3 having a fixed end 31 turned around one horizontal axle 41, and two hydraulic cylinders 2 bilaterally fixed to the pedal support 4. Each of the hydraulic cylinders 2 comprises a casing 21 fixedly secured to the pedal support 4, and a piston rod 22 reciprocating in the casing 21 and pivotably connected to the free end of one pedal 3.

Referring to FIGS. 2 and 3 again, the upright frame 1 is revolvably connected to an upright stub tube 10, which is raised from the base frame 5 at one end, having a horizontal lug 111 near the upright stub tube 10 The horizontal lug 111 defines an elongated sliding slot 1111. The pedal support 4 has a horizontal lug 44 connected to the sliding slot 1111 of the horizontal lug 111 by a screw slot 40. The upright stub tube 10 comprises two horizontal axles 12 bilaterally disposed at the same elevation, two connecting plates 121 respectively turned about the horizontal axles 12, and two substantially U-shaped links 39 respectively connected to the connecting plates 121 by a respective screw 390. Each of the U-shaped links 39 defines a transverse opening 392, which receives one connecting plate 121. The base frame 5 further comprises an upright shaft 51, which supports the pedal support 4. The pedal support 4 is made of hollow structure sleeved onto the upright shaft 51, having a transverse bar 43 near the bottom end. The casings 21 of the hydraulic cylinders 2 are respectively pivoted to the two opposite ends 431 of the transverse bar 43. Each of the pedals 3 further comprises a downward rod 32 raised from the fixed end 31, and a barrel 321 at the bottom end of the downward rod 32. Two U-shaped links 38 are respectively connected to the barrels 321 of the downward rods 32 of the pedals 3 by a screw bolt 380. Each of the U-shaped links 38 defines a vertical opening 382, which receives one barrel 321, and has one side 381 pivoted to one side 392 of the U-shaped link 39 at one connecting plate 121.

Figure 4:
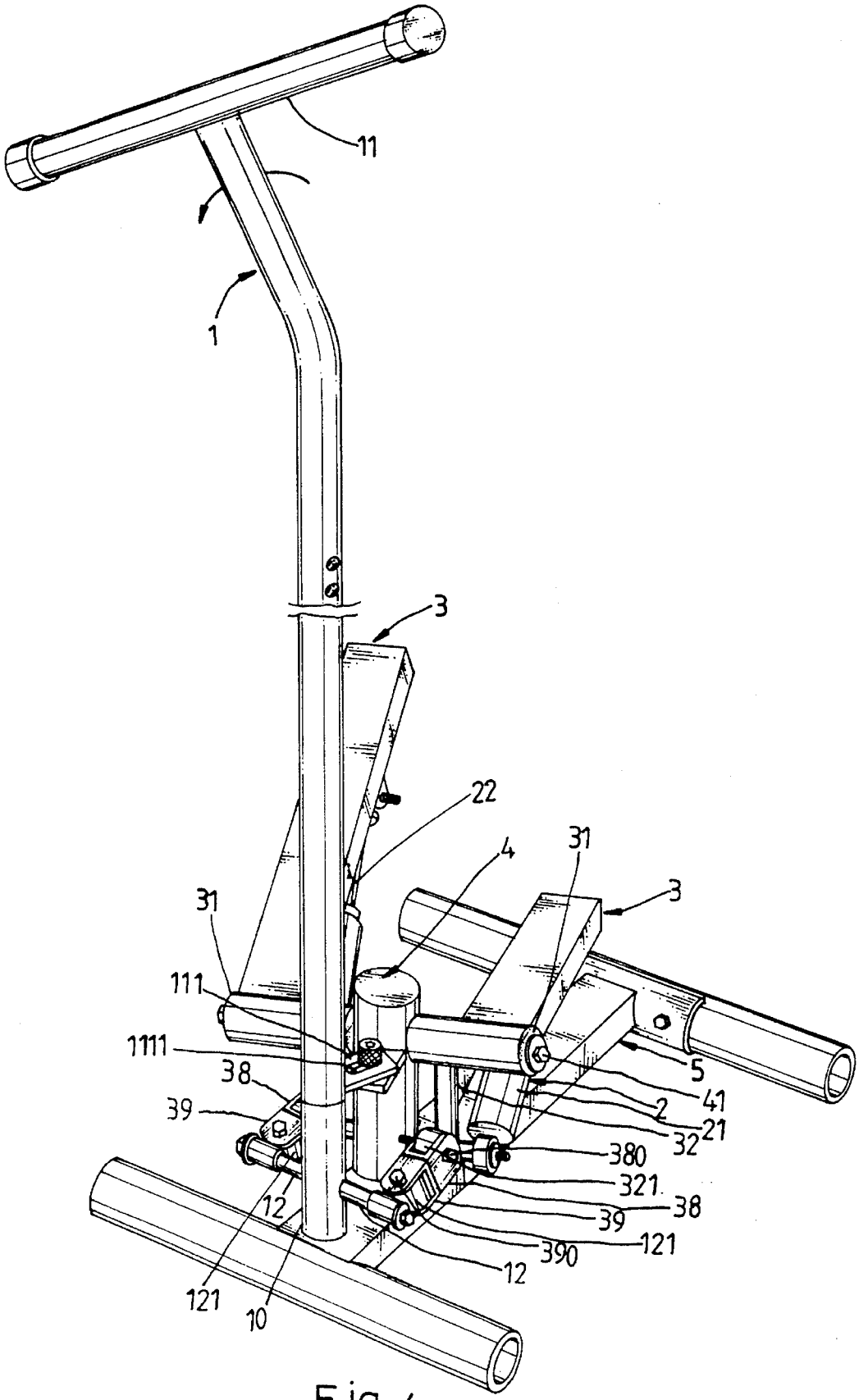
FIG. 4 shows stepping machine of FIG. 2 operated, and the pedal support twisted in one direction.
Figure 5:
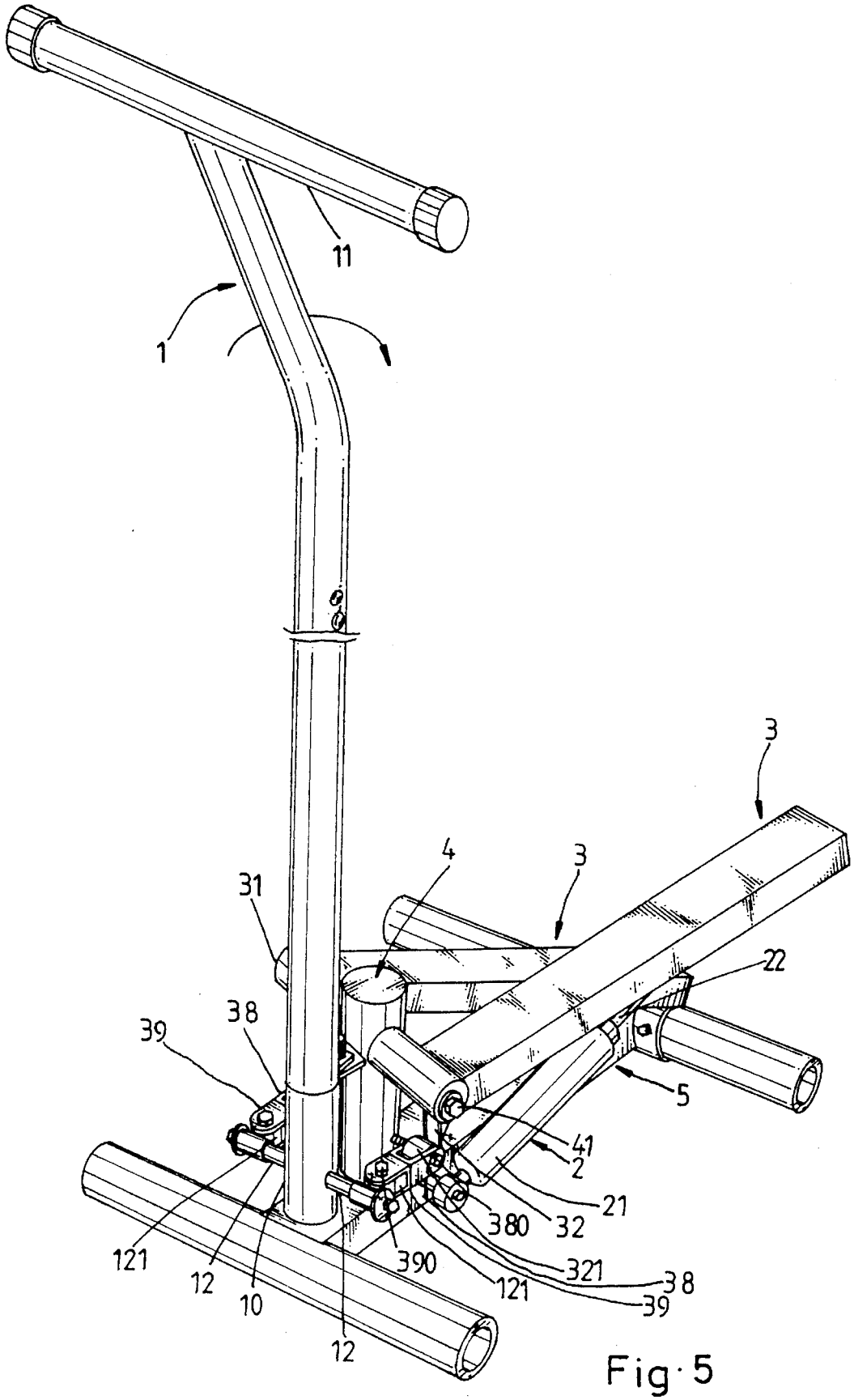
FIG. 5 is similar to FIG. 4 but showing the pedal support twisted in the reversed direction.

Referring to FIGS. 4 and 5, when the pedals 3 are alternatively stepped up and down, the barrels 321 of the downward rods 32 are alternatively forced forwards and backwards, causing the U-shaped links 38 and 39 oscillated back and forth, and at the same time, the lug 111 of the upright frame 1 is forced by the lug 44 of the pedal support 4, causing the upright frame 1 turned back and forth relative to the upright stub tube 10. Therefore, the user is forced to twist the waist when stepping on the pedals 3.

We claim:

1. A stepping machine comprising:

a base frame having an upright stub tube and an upright shaft adjacent to said upright stub tube, said upright stub tube having two horizontal axles bilaterally disposed at the same elevation and two connecting plates respectively turned about said horizontal axles;

an upright post longitudinally connected to said upright stub tube and turned on its longitudinal center axis, said upright post having a lug adjacent to said upright stub tube, the lug of said upright post defining an elongated sliding slot;

a hollow upright pedal support revolvably sleeved onto the upright shaft of said base frame, said upright pedal support comprising a horizontal lug coupled to the elongated sliding slot of the lug of said upright post by fastening means, two horizontal axles bilaterally disposed at the same elevation near a top end thereof, and a transverse bar disposed near a bottom end thereof;

two pedals, each pedal having a fixed end turned about one horizontal axle of said pedal support, and a free end, the fixed end of each pedal having a downward rod terminating in a barrel;

two hydraulic cylinders, each hydraulic cylinder comprising a casing turned about one end of the transverse bar of said pedal support, and a piston rod having one end sliding in said casing and an opposite end pivoted to the free end of one pedals;

two first links respectively pivoted to said connecting plates; and two second links respectively pivotably connected between said first links and the barrels of the downward rods of said pedals.

* * * * *